6/10/86 OR 4,593,846

United States Patent [19]

Evertz et al.

[11] Patent Number: 4,593,846

[45] Date of Patent: Jun. 10, 1986

[54] HAMMER-TOOL, PARTICULARLY FOR DRIVING BOLTS AND LIKE FASTENERS

[76] Inventors: Egon Evertz, Vorländer Str. 23; Rolf Seybold, Eichenstrase 21a, both of 5650 Solingen, Fed. Rep. of Germany

[21] Appl. No.: 559,105

[22] Filed: Dec. 7, 1983

[30] Foreign Application Priority Data

Dec. 7, 1982 [DE] Fed. Rep. of Germany ..... 3245118

[51] Int. Cl.[4] ..... B25C 1/04

[52] U.S. Cl. ..... 227/130

[58] Field of Search ..... 227/130, 8, 156

[56] References Cited

U.S. PATENT DOCUMENTS

| | | | |
|---|---|---|---|
| 3,094,043 | 6/1963 | Powers et al. | 227/130 X |
| 3,272,267 | 9/1966 | Langas | 227/130 X |
| 4,122,904 | 10/1978 | Haytayan | 227/130 X |

*Primary Examiner*—Paul A. Bell

*Attorney, Agent, or Firm*—Holman & Stern

[57] ABSTRACT

A pneumatic hammer-tool designed for driving fastener bolts, in which a piston within a cylinder is charged with compressed air and progressively accelerated in order to drive a fastener bolt, is constructed in such a way that the wall of the cylinder is interrupted by windows on the retracted side of the piston. The axial extension of the windows is less than that of the piston. The cylinder is surrounded by a housing which is connected to a compressed air supply. As the piston is advanced forwardly from its rest position it opens the windows in the cylinder in such a way that compressed air can flow into the cylinder from the surrounding housing and charge and accelerate the piston. In this way much greater kinetic energy is produced. Unintentional actuation of the hammer tool is safely and reliably prevented by a mechanical and a pneumatic safety device.

9 Claims, 3 Drawing Figures

HAMMER-TOOL, PARTICULARLY FOR DRIVING BOLTS AND LIKE FASTENERS

BACKGROUND OF THE INVENTION

The invention relates to a hammer-tool.

Hammer-tools of the prior art work on the principle of acceleration of a striker piston by compressed air applied thereto and, depending on the construction of the valve at the inlet orifice of the cylinder and on the ducting of compressed air in the housing, they are designed either for producing continually repeated fast striker or hammer movements or for producing single individual hammer blows. For driving fastener bolts, those types of tools in which in each case only one single hammer blow is triggered on tool action, are of special interest. For this reason it is advisable to arrange for the piston to pick up a considerable amount of kinetic energy along its acceleration path, which however must not also apply to the return stroke or the piston because in that event the impact of the latter inside the cylinder would cause serious damage. For this reason the venting pipe which in conventional hammer tools serve at the same time for the supply of compressed air for the return stroke of the piston, after appropriate valve-actuation, is provided with a correspondingly small cross section so that only a restricted amount of compressed air, as compared with the operative hammer blow, can be applied to the rear side of the striker piston and consequently the latter only acquires a correspondingly reduced speed. This means that during the operative hammer blow the outflowing air must also surmount the throttle effect of the vent aperture and this limits acceleration. A further limitation resides in that the inlet to the cylinder can only be progressively opended on valve actuation at a comparatively slow speed. This means that the striker piston commences its operative stroke under an initially still very small charge and has already covered a portion of its operative travel by the time it receives the full compressed air charge. Thus only an abbreviated residual travel distance and correspondingly shortened time remains available for maximum possible acceleration.

SUMMARY OF THE INVENTION

It is an object of the present invention to provide the inventive hammer-tool with operation at considerably increased impact energy. Overall weight, however, remains fairly low so that the impact energy is produced substantially by or through the speed of piston displacement. Likewise, such increase in impact energy is not to detract in any manner from operational safety. On the contrary, the operational safety provisions of the new hammer-tool are reliable. The arrangement has a particularly high degree of simplicity.

These objectives and problems are achieved and solved by apparatus of the present invention.

The window-like aperture in the cylinder wall of the present invention makes it possible to create here, even for a relatively short axial extension only, an open section of very considerable size through which the compressed air may flow from the housing into the interior of the cylinder once the piston has been displaced from its rest position sufficiently far forwards to reveal the initial sections of the windows. The piston will then pick up along an adjacent flight-path a very high acceleration which steadily further increases along the axial extension of the windows because the degree of compressed air charge application to the piston increases commensurately with its further advancement in the forward direction.

In all, the speed of the piston inside the cylinder can already increase after a very brief time to a hitherto unachievable degree so that finally the piston in continuation of its operative travel can pick up kinetic energy in corresponding manner and release it again for the actual bolt-driving blow or like action. The restoring force returns the piston to its initial position after the blow has been delivered.

The initial advancement of the piston may be produced in various manners, for example by means of an object which influences the piston mechanically. It is particularly convenient, however, to advance the piston from a rest position by means for the compressed air which is already present for the purpose of triggering the operative blow. To this end there is provided a compressed air chamber adjacent the piston with a control line for compressed air feed. In order to ensure sufficiently fast release of the piston, from its starting position the flow section of this control connection leading to the compressed air supply, is approximately four times as large as the flow section through which the housing of the cylinder communicates with the compressed air supply. By virtue of its considerable interior volume the housing works like a tank into which the compressed air which was apruptly withdrawn after piston release may then flow at a relatively slow speed to fill up the tank. After switch-over the restoration of the piston is preferably also affected by means of compressed air, again fed through a flow section four times as large as the communicating flow section between housing and cylinder. In both cases the respective larger flow section enables strong load application to the piston in one or the other direction so that it executes its movement relative to an environment at inferior pressure.

During the advancement of the piston the interior of the cylinder requires venting through the earlier mentioned air-vent line. Conveniently therefore the latter is provided with a non-return valve which can be opened directly prior to release of the bearing. A particularly suitable mechanism for this purpose is a feeler pin which is arranged in the frontal part of the hammer-tool and spring-loaded so that when the tool is set down on a surface into which a fastener or the like is to be driven, this feeler pin can be displaced inwardly, or pushed 'in'. This displacement may then be easily transmitted by suitable lever-linkage to the non-return valve so that the latter will be displaced into the open position. An important factor for the venting process resides in that when the means of advancing the piston are released, or triggered, the compressed air inside the cylinder will already have escaped to such an extent that the piston no longer has to surmount opposing air pressure in the course of its forward movement. For this reason the vent aperture of the cylinder will preferably have about ten times as large a flow section as the communicating section between the housing and the compressed air supply. This will make the vent orifice approximately two and a half times larger than the control-pipe connection for compressed air application to the piston so that the dynamics of piston movement may be used in a particularly reliable and safe manner for opening the valve in the manner provided.

In view of the earlier mentioned switch-over for the purpose of applying compressed air to the piston in the direction of returning it to the starting position it is advisable to provide the cylinder, on the piston-extention side thereof, with a valve connection through which it can be supplied with compressed air via a flow section which, as already mentioned, is about four times as large as the communicating flow section between the housing and the compressed air supply.

Preferably a two-position four-way valve will be used for the release or trigger process. With the aid of such a valve it is possible, at rest position, to maintain a communication between the compressed air chamber and an air vent on the one hand, and between the valve connection of the cylinder and a compressed air supply source on the other. By contrast, when the valve is actuated it will establish a communication between the compressed air chamber and the compressed air supply source on the one hand, and between the valve connection to the cylinder interior and the air vent pipe on the other. The actuating mechanism for such a valve can be easily accomodated in a grippling handle which must be provided on the tool in any case for holding the housing.

Furthermore, the operational safety of the new hammer-tool is improved by providing a safety device in respect of the operative release or triggering of the means which advance the piston from its initial position, said safety device being in the form of a piston-cylinder unit which is appropriately connected to the pressure side via the valve connection to the interior of the cylinder. When the piston has assumed its retracted position under the influence of compressed air, the said piston-cylinder unit will have been displaced by the same compressed air into its extended position and in this position it will block the release of the piston-advancing means. However, as soon as the vent pipe is liberated by inward displacement of the feeler pin the piston-cylinder unit retracts under the effect of its spring loading device and thereby liberates the trigger mechanism.

The reliable isolation of the housing relative to the interior of the cylinder in the region of the above-mentioned windows by means of the piston is achieved in a preferred embodiment by providing the latter with a ring seal in the vicinity of its outwardly directed edge. This ring seal is effective along the full distance of piston travel, that is to say also when it is initially advanced from its rest position and then flies on to the end of stroke. In order also to obtain a good seal on the other side of the piston it is advisable to provide between the inwardly directed edge of the cylinder and the start of the window a ring seal for the piston in the inside wall of the cylinder which can however seal off the piston only in its completely restricted position. Nevertheless the sealing effect provided by this last mentioned seal is enough to achieve a sufficiently long distance of piston travel when compressed air is applied to the piston until the compressed air can freely flow into the cylinder through the windows and further accelerate the piston as described.

BRIEF DESCRIPTION OF THE DRAWINGS

The present invention is more particularly described with reference to the accompanying drawings in which, each in schematic view, are shown.

DETAILED DESCRIPTION OF THE INVENTION

Figure 1:
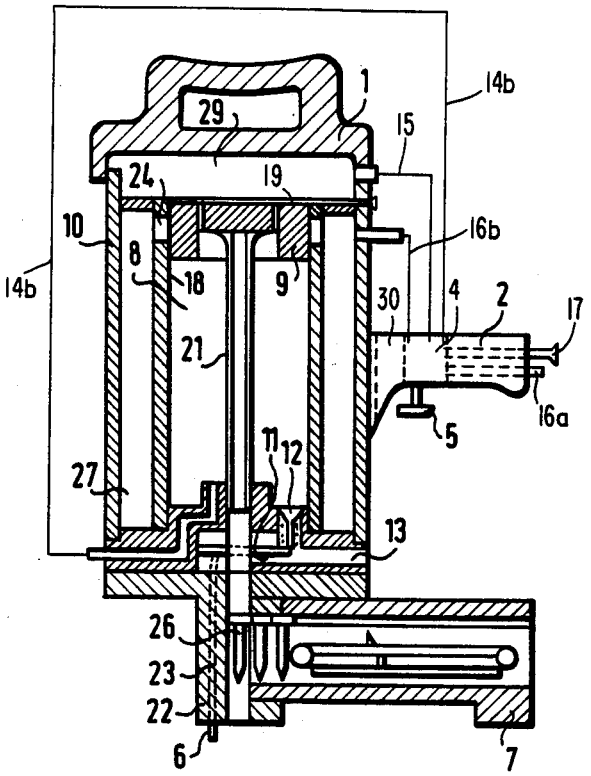
FIG. 1 is a longitudinal section through the hammer tool of the present invention.

As shown in FIG. 1, the new hammer tool is held by the user by a gripper handle 1 and a pistol grip 2. The trigger 5 which operates the two-position-four-way slide valve 4, releases the slide hammer by reciprocating inside the piston grip 2 along the direction 5'. However, it is held in its initial position by the safety bolt 3 so that no unintentional, accidental trigger-release can occur. See FIG. 2.

The above mentioned safety bolt 3 is a part of the piston-cylinder-unit 30, in that it is designed as the outwardly extendable terminal section of a piston rod, the associated piston of which is under the bias of a spring inside the cylinder. This piston-cylinder-unit is adapted to be charged with compressed air via an air connection 14*a* in a manner which will be more particularly described below so that the piston rod will be extended and the safety bolt block the trigger 5 and slide valve 4, which are typically spring-loaded The gripping handle 1 and the piston grip 2 are secured to housing 10. Inside housing 10 is the cylinder 8 with the windows 24 which may be observed in that section thereof which is on the retraction side of the piston 9. At its upper rim the cylinder 8 is further provided with a stop and ring seal 28 which seals the piston 9 when fully retracted and prevents it from flying out the back of the hammer unit.

Figure 3:
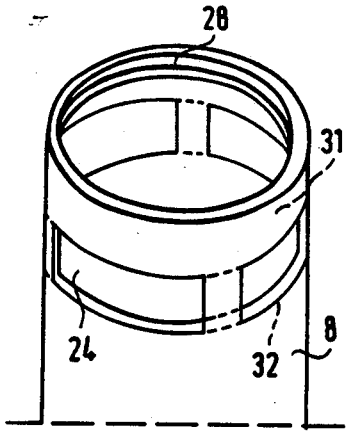
FIG. 3 is a perspective view of the cylinder section on the retraction side.

The position of the stop and ring seal 28 above the windows 24 is shown in FIG. 3. The piston 9 is slidable inside the cylinder 8, along with its fixed piston rod 21 passing through a borehole 21*a* on the extension side of the piston to hit a bolt 26, when the piston is extended and drive it into a given wall or the like. The bolts 26 are arranged in a magazine 7. The frontal piece 22 of the tool, besides containing the magazine 7 and the borehole 21*a* for the piston rod 21 and associated bolt 26, comprises a further bore or channel 23 to receive the feeler pin 6. When the mouth of the tool is put down on the impact site the feeler pin 6 is pushed inwards and its inwardly directed end applied to an elastically mounted lever 11 which in turn by its end engages the non-return valve 12 and lifts the latter so that the vent pipe 13 is opened through the action of the nonreturn valve 12 and the interior of cylinder 8 vented very rapidly while the piston 9 is in its retracted position.

Figure 2:
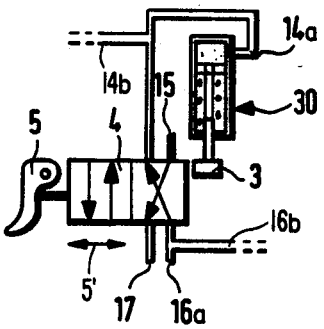
FIG. 2 shows the valve which is provided for the actuation of the hammer-tool of the present invention.

In consequence of this venting action the piston-cylinder unit 30 will also be vented at the same time so that, under the influence of a spring surrounding it inside the cylinder, its piston rod will retract and displace the safety bolt 3 in such a way as to release or liberate the trigger 5 and valve 4 for effective tool-actuation. However, initially the two-position-four-way valve 4 which is to be actuated thereby still connects the control connection 15, through which the pressure chamber 29 and thus the face of piston 9 are adapted to be charged with compressed air, with the external vent line 17, as shown in FIG. 2. Likewise, the air connection 14*b* which leads into the interior of the cylinder 8 on the extendion side of the piston 9 is at this stage still in communication with the compressed air supply line 16*a*. In other words, compressed air still flows through this line into the cylinder 8. However, since the cross-section of exhaust or vent line 13 is about two-and-a-half times larger than the cross-sectional flow area of line 14*b* supplying the interior of cylinder 8 no significant pressure can build up within the cylinder during this exhaust phase.

When the trigger 5 is actuated the air connection 14*b* will be connected with the vent pipe 17*b* by the slidable two-position-four-way valve 4 whilst the control connection 15 is brought into communication with the pressure supply line 16*a*. By contrast, the annular space 27 inside housing 10 is constantly connected with the compressed air supply source through a relatively narrow communicating air channel or line 16*b*.

The entry of compressed air into the compressed air chamber 29 causes pressure to be applied to the face of piston 9 which is thereupon displaced downward a short distance from its initial position during which phase it is initially still sealed relative to the upper inside wall of cylinder 8 by the ring seal 28 which may be observed in FIG. 3.

Besides this there is at the leading-edge of the piston a typical annular piston seal not shown which slides along the cylinder's inner wall 18. When the piston has been sufficiently far advanced it reveals the top edge of the windows 24. From this point onwards compressed air flows from the annular space 27 through the windows 24 into the cylinder 8 and drives the piston 9 further downward. As already described, the pressurized section of cylinder 8 grows the larger the more the piston is axially displaced downward until eventually the whole aperture of the windows 24 is fully available. The frontal piston seal keeps the piston effectively sealed relative to cylinder wall 18 during the subsequent acceleration travel period.

When the bolt 26 has been driven and the tool is taken off the driving site the feeler pin 6 moves out to the front again so that the non-return valve 12 closes. When the trigger 5 is released by the operator the two-position four-way valve returns to the position shown in FIG. 2. This means that compressed air penetrates into the interior of cylinder 8 through the larger flow section of line 14*b* than applicable to the control air line 15 which supplies the upper space 29. Consequently the piston 9 slides back to its initial retracted position. The pressure which has built up inside the cylinder 8 further restores through air line 14*a* the piston-cylinder-unit 30 to the position shown in FIG. 2 which thereby locks the trigger mechanism 5.

In order to ensure, in the event of potential leakage of the two-position-four-way valve, that no unduly high pressure can build up inside the upper chamber 29 which might displace the piston 9, there is further provided a safety orifice 19 which has a very small cross-section through which pressure compensation and equalization relative to atmosphere is achieved when the tool is not in operation.

The window-like aperture of perforation may also extend over the whole of the upper cylinder circumference so as to create a still larger inlet flow cross-section for the compressed air, in which case the cylinder 8 would then completely terminate at its upper edge designated 32 in FIG. 3. The web portions between the windows as shown in FIG. 3 could then be completely omitted. In that case the upper section of the cylinder would be constructed as a sleeve or box 31 of small axial extension spaced axially from cylinder 8 to the extent that the height of the window provided. This sleeve, or box 31 would then be provided with the inner piston stop and ring seal 28 so that, as will be noted from FIG. 1, in its totally retracted position the piston 9 is sealed and guided at the bottom by cylinder 8 and at the top by the sleeve 31. Besides providing further simplification this arrangement has the added advantage that a still larger cross section is exposed for forward displacement of piston 9.

We claim:

1. A tool, for driving bolts and like fasteners, comprising:

a piston having a height; a valve; a cylinder adapted to be charged with compressed air by actuation of said valve, said piston picking up impact energy along an acceleration path; said cylinder having an inlet orifice disposed on a side of said cylinder;

said piston being disposed for travel inside said cylinder; said cylinder being disposed within a surrounding housing and is connected to a compressed air supply; said port being disposed on a side of said cylinder which is opposite said side on which said inlet orifice is disposed;

an upper wall of said cylinder on a side of said cylinder; which corresponds to a retracted piston position, is perforated by windows; each one of said windows having an axial extension which is less than that of said piston height, wherein in said retracted piston position said piston overlaps said windows and is displaceable from this position for triggering a strike action by movement to an axial position thereby exposing progressively an initial upper section of said windows, said piston being further subjected to a restoring force by a means for restoring.

2. A tool according to claim 1, wherein a window-like aperture in said cylinder extents about the entire upper circumference of said cylinder so that said cylinder, on that side which corresponds to said retracted piston position, terminates in an axially spaced sleeve which guides said piston to its said retracted piston position in said housing.

3. A tool according to claim 1, wherein an exhaust line from said cylinder is closed by means of a non-return valve which can be opened when a feeler pin is set down on a driving site due to an inward displacement of said feeler pin.

4. A tool according to claim 3, further comprising a safety means for triggering advance of said piston; said safety means having a trigger; said safety means further comprising a piston-cylinder unit arranged so that in said retracted position of said piston; said piston is extended by a restoring force under the influence of compressed air and thereby blocks release of said trigger, said safety means being then connected on its compressed air side to an interior of said cylinder, whereas when a feeler pin is pushed in said cylinder compressed air vents through said exhaust line of said cylinder and retracts by spring action thereby liberating said trigger.

5. A tool according to claim 1, wherein said piston is initially advanced from said retracted piston position by force of compressed air introduced into an adjacent compressed air chamber through a control air line from a compressed air supply; said control line having a flow cross section of approximately four times a communication flow cross section of an air supply line feeding said housing of said cylinder; whereby said piston is restored to said retracted piston position after impact by force of said compressed air.

6. A tool according to claim 5, wherein said flow cross section of said exhaust line of said cylinder is approximately ten times as large as said communication flow cross section of said compressed air supply line which feeds said housing.

7. A tool according to claim 6, wherein said compressed air communicates with said piston through an air connection terminating in said cylinder on an extension side thereof with said flow cross section being approximately four times as large as said communicating flow cross section of said compressed air line which supplies said housing with compressed air.

8. A tool according to claim 7, wherein actuation of a slidable pistol trigger operates a two-position-four-way valve, which valve when in a rest position connects said compressed air chamber with an air vent and also connects an air connection with said compressed air supply, while in a working position said valve connects said compressed air chamber with said compressed air supply and said air connection with said air vent.

9. A tool according to claim 1, wherein said piston has a ring seal sealing it relative to said cylinder; and said upper cylinder is provided, at a point thereof situated between a retraction-side edge and a start portion of said windows, with an inner ring seal sealing said piston only when it is completely retracted.

* * * * *